US008448476B2

(12) United States Patent
Lee

(10) Patent No.: US 8,448,476 B2
(45) Date of Patent: May 28, 2013

(54) WARP KNITTING FABRICS HAVING GROUND ORGANIZATION EXPRESSING VARIOUS DESIGN PATTERNS

(75) Inventor: Il-Soo Lee, Seoul (KR)

(73) Assignee: Yong Uk Lee, Seoul (KR)

( * ) Notice: Subject to any disclaimer, the term of this patent is extended or adjusted under 35 U.S.C. 154(b) by 0 days.

(21) Appl. No.: 13/574,871

(22) PCT Filed: Mar. 4, 2011

(86) PCT No.: PCT/KR2011/001532
§ 371 (c)(1),
(2), (4) Date: Jul. 24, 2012

(87) PCT Pub. No.: WO2011/108899
PCT Pub. Date: Sep. 9, 2011

(65) Prior Publication Data

US 2012/0291495 A1 Nov. 22, 2012

(30) Foreign Application Priority Data

Mar. 4, 2010 (KR) ..... 10-2010-0019262

(51) Int. Cl.
*D04B 21/00* (2006.01)

(52) U.S. Cl.
USPC ..... 66/195

(58) Field of Classification Search
USPC ..... 66/193, 194, 195
See application file for complete search history.

(56) References Cited

U.S. PATENT DOCUMENTS

| | | | | | |
|---|---|---|---|---|---|
| 2,608,079 | A * | 8/1952 | Slater | 66/195 |
| 3,922,888 | A * | 12/1975 | Patterson | 66/192 |
| 4,280,259 | A * | 7/1981 | Bassist | 28/160 |
| 4,527,404 | A * | 7/1985 | Nakagaki et al. | 66/202 |
| 5,172,570 | A * | 12/1992 | Wade et al. | 66/195 |
| 6,276,177 | B1 * | 8/2001 | West | 66/192 |
| 6,305,196 | B1 * | 10/2001 | Takeshita et al. | 66/195 |
| 8,028,547 | B2 * | 10/2011 | Suzuki et al. | 66/192 |

FOREIGN PATENT DOCUMENTS

| | | |
|---|---|---|
| JP | 03-019945 X2 | 1/1991 |
| KR | 20-1987-0001726 Y1 | 5/1987 |
| KR | 20-0278622 Y1 | 6/2002 |

OTHER PUBLICATIONS

Korean Intellectual Property Office, International Search Report of PCT/KR2011/001532, Jan. 12, 2012.

* cited by examiner

*Primary Examiner* — Danny Worrell
(74) *Attorney, Agent, or Firm* — Sherr & Jiang, PLLC

(57) ABSTRACT

Provided are warp knitting fabrics having a ground organization expressing various design patterns. The warp knitting fabrics comprise: a ground organization formed with warps knitted into a loop shape; and a pattern organization knitted on the ground organization, wherein the ground organization includes two or more unit designs continuously arranged in a transverse direction of the ground organization, each of the unit designs comprises two or more unit organizations arranged in a longitudinal direction of the ground organization, each of the unit organizations comprising a specific loop shape of a network structure formed by a chain of a specific chain number group comprising an array of a plurality of chain numbers, and each of the unit organizations has a different loop shape of a network structure from each other.

8 Claims, 21 Drawing Sheets

– Prior Art –

– Prior Art –

– Prior Art –

Fig. 9

G2 chain combination array

| | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| 0 | 2 | 6 | 4 | 8 | 4 | 6 | 2 | 6 | 4 | 8 | 4 | 6 | 2 | 6 | 4 |
| 15 | 8 | 4 | 6 | 2 | 6 | 4 | 8 | 4 | 6 | 2 | 6 | 4 | 8 | 4 | 6 |
| 30 | 2 | 6 | 4 | 8 | 4 | 6 | 2 | 6 | 4 | 8 | 4 | 6 | 4 | 8 | 4 |
| 45 | 8 | 2 | 6 | 2 | 8 | 4 | 8 | 2 | 6 | 2 | 8 | 4 | 8 | 2 | 6 |
| 60 | 2 | 8 | 4 | 8 | 2 | 6 | 2 | 8 | 4 | 8 | 2 | 6 | 2 | 8 | 4 |
| 75 | 8 | 2 | 6 | 2 | 8 | 4 | 6 | 4 | 6 | 4 | 8 | 2 | 6 | 4 | 8 |
| 90 | 2 | 6 | 4 | 8 | 2 | 6 | 4 | 8 | 2 | 6 | 4 | 8 | 2 | 6 | 4 |
| 105 | 8 | 2 | 6 | 4 | 8 | 2 | 6 | 4 | 8 | 2 | 6 | 4 | 8 | 2 | 6 |
| 120 | 4 | 8 | 2 | 6 | 4 | 6 | 4 | 6 | 4 | 8 | 4 | 8 | 4 | 6 | 2 |
| 135 | 6 | 2 | 6 | 4 | 8 | 4 | 8 | 4 | 6 | 2 | 6 | 2 | 6 | 4 | 8 |
| 150 | 4 | 8 | 4 | 6 | 2 | 6 | 2 | 6 | 4 | 8 | 4 | 8 | 4 | 6 | 2 |
| 165 | 6 | 2 | 6 | 4 | 8 | 4 | 6 | 4 | 6 | | | | | | |

:A1 :B1 :C1 :D1

Fig. 10

G3 chain combination array

| | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| 0 | 2 | 6 | 4 | 8 | 2 | 6 | 4 | 8 | 2 | 6 | 4 | 8 | 2 | 6 | 4 |
| 15 | 6 | 4 | 6 | 4 | 8 | 4 | 8 | 4 | 6 | 2 | 6 | 2 | 6 | 4 | 8 |
| 30 | 4 | 8 | 4 | 6 | 2 | 6 | 2 | 6 | 4 | 8 | 4 | 8 | 4 | 6 | 2 |
| 45 | 6 | 2 | 6 | 4 | 8 | 4 | 8 | 4 | 6 | 2 | 6 | 2 | 6 | 4 | 8 |
| 60 | 4 | 6 | 4 | 6 | 2 | 6 | 4 | 8 | 4 | 6 | 2 | 6 | 4 | 8 | 4 |
| 75 | 6 | 2 | 6 | 4 | 8 | 4 | 6 | 2 | 6 | 4 | 8 | 4 | 6 | 2 | 6 |
| 90 | 4 | 8 | 4 | 6 | 2 | 6 | 4 | 8 | 4 | 6 | 2 | 6 | 4 | 8 | 4 |
| 105 | 6 | 4 | 8 | 4 | 8 | 2 | 6 | 2 | 8 | 4 | 8 | 2 | 6 | 2 | 8 |
| 120 | 4 | 8 | 2 | 6 | 2 | 8 | 4 | 8 | 2 | 6 | 2 | 8 | 4 | 8 | 2 |
| 135 | 6 | 2 | 8 | 4 | 8 | 2 | 6 | 2 | 8 | 4 | 6 | 4 | 6 | 4 | 8 |
| 150 | 2 | 6 | 4 | 8 | 2 | 6 | 4 | 8 | 2 | 6 | 4 | 8 | 2 | 6 | 4 |
| 165 | 8 | 2 | 6 | 4 | 8 | 2 | 6 | 4 | 8 | | | | | | |

:A1 :B1 :C1 :D1

WARP KNITTING FABRICS HAVING GROUND ORGANIZATION EXPRESSING VARIOUS DESIGN PATTERNS

CROSS REFERENCE TO PRIOR APPLICATIONS

This application is a National Stage Patent Application of PCT International Patent Application No. PCT/KR2011/001532 (filed on Mar. 4, 2011) under 35 U.S.C. §371, which claims priority to Korean Patent Application Nos. 10-2010-0019262 (filed on Mar. 4, 2010), which are all hereby incorporated by reference in their entirety.

TECHNICAL FIELD

The present invention relates to warp knitting fabrics having a ground organization and a pattern organization formed by a Raschel machine that is a kind of warp knitting machine, and more specifically, to warp knitting fabrics having a ground organization expressing various design patterns.

BACKGROUND ART

In general, warp knitting fabrics are knitted by forming a plurality of original yarns arranged in parallel with one another into loops and sequentially connecting the loops in the longitudinal direction.

Since the warp knitting fabrics are sensitive to tension, the warp knitting fabrics have a shape and dimension easily changed in the lateral and longitudinal directions and excellent elasticity and flexibility. As the warp knitting fabrics are variously applied not only to clothing materials but also to interior or industrial materials, demands on the warp knitting fabrics are continuously increased.

Warp knitting machines for knitting warp knitting fabrics is classified into a tricot warp knitting machine and a Raschel machine. The tricot warp knitting machine has high productivity for mass production, but the organization of fabrics produced by the Raschel machine is simple. The Raschel machine has low productivity, but is able to produce fabrics having a complicated organization and thus it is possible to produce fabrics having various designs.

The Raschel machine is provided with a plurality of ground guidebars for forming a ground organization of fabrics and a plurality of pattern guidebars for forming a pattern organization for fabrics.

The Raschel machine is generally provided with 18 to 53 guidebars, and a plurality of knitting needles having original yarns fed thereto are arranged on each of the guidebars. Each of the guidebars is connected to a shogging lever operated in conjunction with a chain.

A chain is assembled with unit chains having various shapes, and the operating distance of the shogging lever is changed depending on the shape of each of the unit chains. The shogging levers operated by the chain are connected to the respective guidebars by a guidebar push rod, and each of the guidebars is operated by the shogging lever. Thus, the operating direction and distance of the guidebar are changed depending on the shape of the chain linked with the shogging lever, and accordingly, fabrics having various patterns are knitted by the knitting needles mounted to the guidebar.

The ground organization is generally knitted by two ground guidebars, and three ground guidebars may be used according to the shape of a unit design. However, in a general Raschel machine, the diameter of a ground guide chain drum is relatively small, and hence the number of combined unit chains is limited. As a result, the design of the ground organization is also simplified.

FIGS. 1 and 2 are plan views showing conventional warp knitting fabrics formed by a Raschel machine. As shown in FIGS. 1 and 2, the ground organization of the conventional warp knitting fabrics has only one simple design pattern. Since the length of a chain for forming the ground organization is short, and the number of unit chains combined with the chain is limited to a small number, it is impossible to various ground organizations.

DETAILED DESCRIPTION

Technical Problems

It is thus an object of the present invention to provide warp knitting fabrics in which the unit organizations configured into a network structure having various shapes are consecutively expressed in the form of various unit designs, and the unit designs have various types of array structures.

It is thus another object of the present invention to provide warp knitting fabrics having a harmonious and distinct three-dimensional effect by combining various pattern organizations on a ground organization having various design shapes.

Technical Solutions

To solve the objective, the present invention provides warp knitting fabrics comprising: a ground organization formed with warps knitted into a loop shape; and a pattern organization knitted on the ground organization, wherein the ground organization includes two or more unit designs continuously arranged in a transverse direction of the ground organization, each of the unit designs comprises two or more unit organizations arranged in a longitudinal direction of the ground organization, each of the unit organizations comprising a specific loop shape of a network structure formed by a chain of a specific chain number group comprising an array of a plurality of chain numbers, and each of the unit organizations has a different loop shape of a network structure from each other.

The unit organizations may be formed by consecutively knitting a plurality of loops having the same shape in the longitudinal direction.

The unit organizations may be knitted by at least two ground guidebars linked with the chain of the specific chain number group comprising the array of the plurality of chain numbers.

The loop shape of the network structure may be any one of a quadrangular shape, a diamond shape, a lozenge shape and a hexagonal shape.

The ground organization may comprise at least two-row unit designs, and the unit organizations of any one unit design may be arrayed in zigzag with the unit organizations of another unit design in the transverse direction.

The ground organization may comprise at least two-row unit designs, and the unit organizations of any one unit design may be arrayed in parallel with the unit organizations of another unit design in the transverse direction.

The ground organization may comprise at least two-row unit designs, and the width of any one unit design may be wider than that of another unit design adjacent to the one unit design in the transverse direction.

The length of one unit organization may be longer than that of another unit organization adjacent to the one unit organization in the longitudinal direction.

Advantageous Effects

Based on the above structure, it is possible to produce warp knitting fabrics in which the unit organizations configured into a network structure having various shapes are consecutively expressed in the form of various unit designs, and the unit designs have various types of array structures.

Further, it is possible to provide warp knitting fabrics having a harmonious and distinct three-dimensional effect by combining various pattern organizations on a ground organization having various design shapes, so that the high quality of the warp knitting fabrics can be ensured.

Further, the chain arrangement and mechanical structure of the conventional Raschel machine is remodeled, so that it is possible to ensure the reduction in the cost of equipment and the rationalization of an equipment space.

BRIEF DESCRIPTION OF DRAWINGS

FIGS. 9 and 10 are chain layouts for forming a unit design according to a second embodiment of the present invention;

BEST MODES FOR PRACTICING INVENTION

Figure 1:
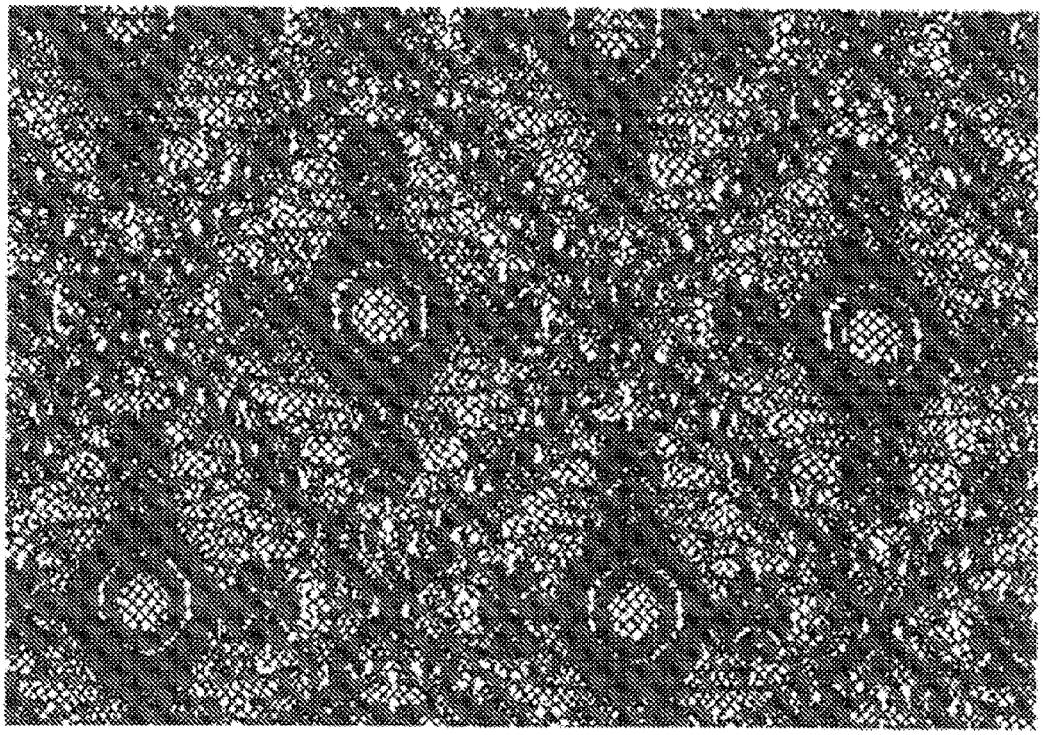
FIGS. 1 and 2 are plan views showing warp knitting fabrics formed by a conventional Raschel machine.
Figure 2:
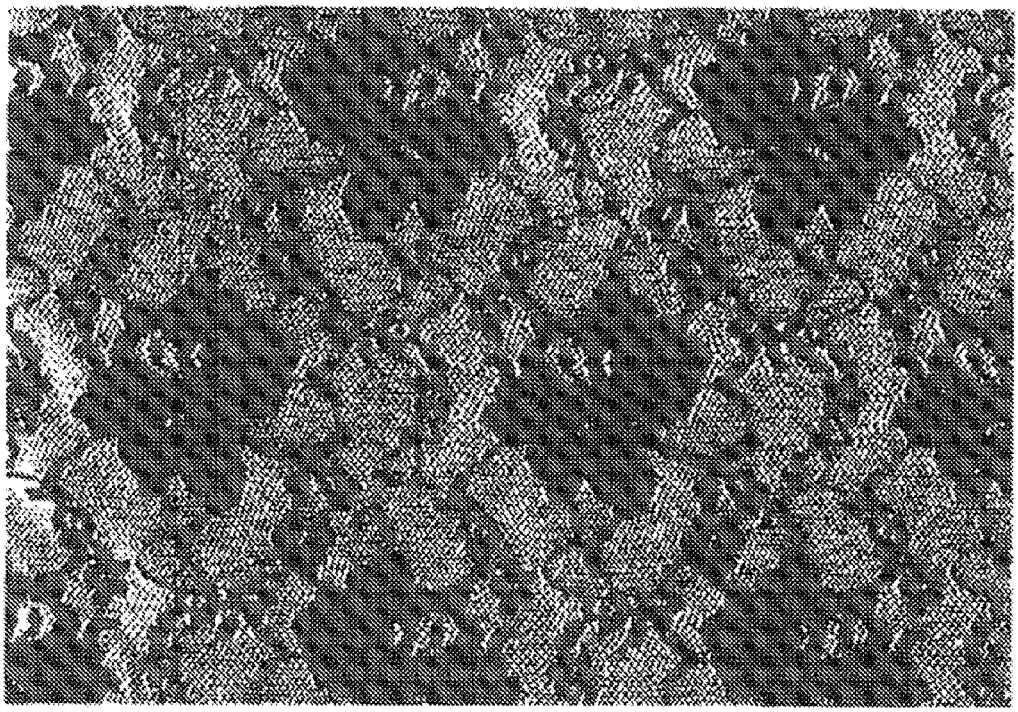

The present invention now is described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like reference numerals indicate like elements throughout the specification.

Hereinafter, embodiments of warp knitting fabrics having a ground organization expressing various design patterns according to the present invention will be described in detail with reference to the accompanying drawings.

The term "unit chains" described hereinbelow refer to assembling components that become minimum units in the assembling of a chain manufactured in various shapes by combining its length, height and gradient.

In this case, the unit chains are distinguished from one another by respectively providing the unit chains to numbers. For example, the unit chain having a high number means that its cut inclined surface is long. As the inclined surface is lengthened, much time is taken to operate the unit chain, and therefore, a guide bar is operated long.

The term "chain number group" refers to one group composed of a plurality of numbers obtained by consecutively arranging chain numbers of the unit chains.

The term "unit organization" refers to a ground organization having a network structure of a certain shape, formed by a plurality of unit chains assembled so that chain number groups are consecutively repeated.

The term "unit design" refers to one design constituting one cycle by consecutively forming the plurality of unit organizations in the knitting direction (longitudinal direction).

Figure 3:
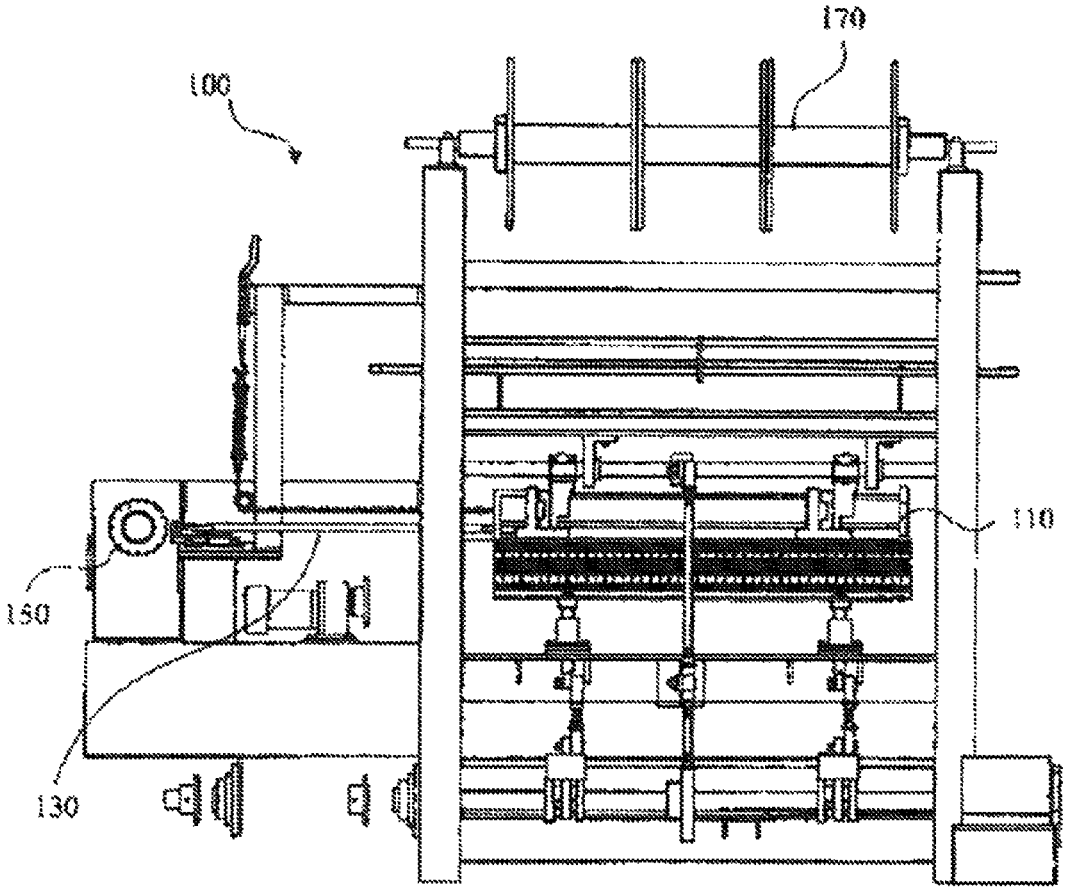
FIG. 3 is a view showing a general Raschel machine.

FIG. 3 is a view showing a general Raschel machine 100. In the general Raschel machine, a ground guidebar 110 is operated in conjunction with a ground guide chain drum 150 by a ground guidebar push rod 130 to the left side thereof.

An apparatus for producing warp knitting fabrics according to the present invention is an apparatus obtained by remodeling the general Raschel machine. Like the conventional Raschel machine, a first ground guidebar is linked with the conventional ground guide chain drum, and second and third ground guidebars are linked with a separate chain drum.

Figure 4:
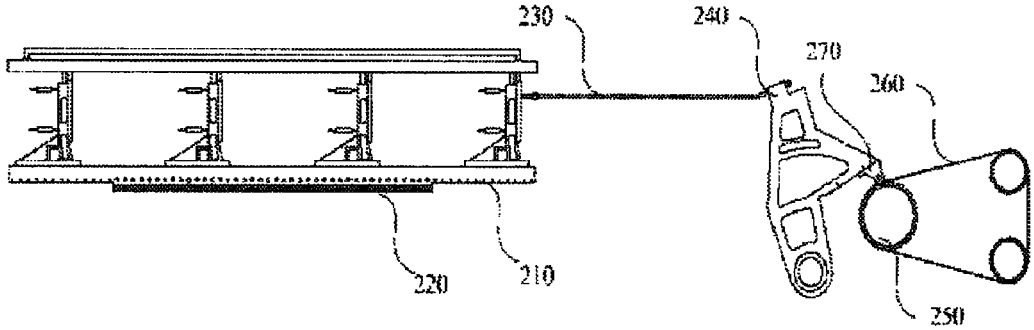
FIG. 4 is a view showing a connection relationship between a ground guidebar and a chain operating the ground guidebar in a Raschel machine according to the present invention.

FIG. 4 is a view showing a connection relationship between the second ground guidebar (or third ground guidebar) and a chain operating the ground guidebar in the Raschel machine according to the present invention.

Referring to FIG. 4, one end of a ground guidebar push rod 230 is connected to the right side of a second ground guidebar 210, and the other end of the ground guidebar push rod 230 is connected to a shogging lever 240. A shogging bearing 270 is provided to a side of the shogging lever 240. The shogging bearing 270 comes in contact with a surface of a chain 260 wound around a ground guide chain drum 250. The unit chains constituting the chain 260 perform an operation of pushing the shogging bearing 270, and therefore, the operating distance of the shogging lever 240 is changed depending on the shape of each of the unit chains. Although only the connection state of the second ground guidebar has been illustrated in FIG. 4, the third ground guidebar also has the same connection state.

In the conventional Raschel machine, the first and second ground guidebars are operated in one pattern, and accordingly, a ground organization having the one pattern is formed. However, in the present invention, the second and third ground guidebars can be operated in various patterns, and accordingly, a ground organization having various patterns is formed.

Figure 5:
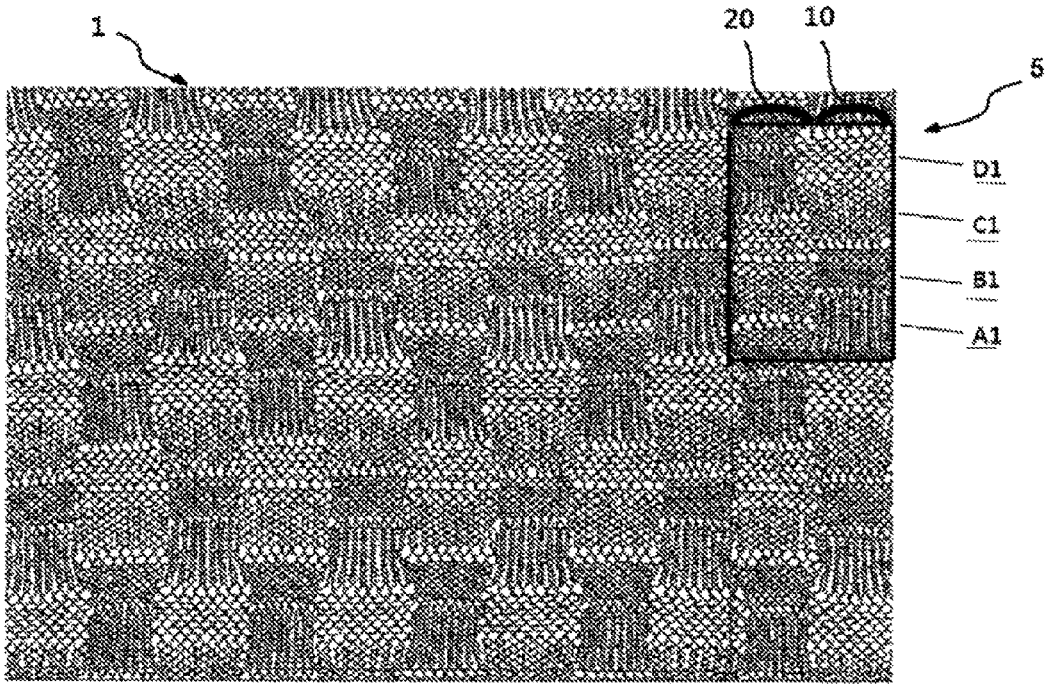
FIG. 5 is a view showing a ground organization having various design patterns according to a first embodiment of the present invention.
Figure 6:
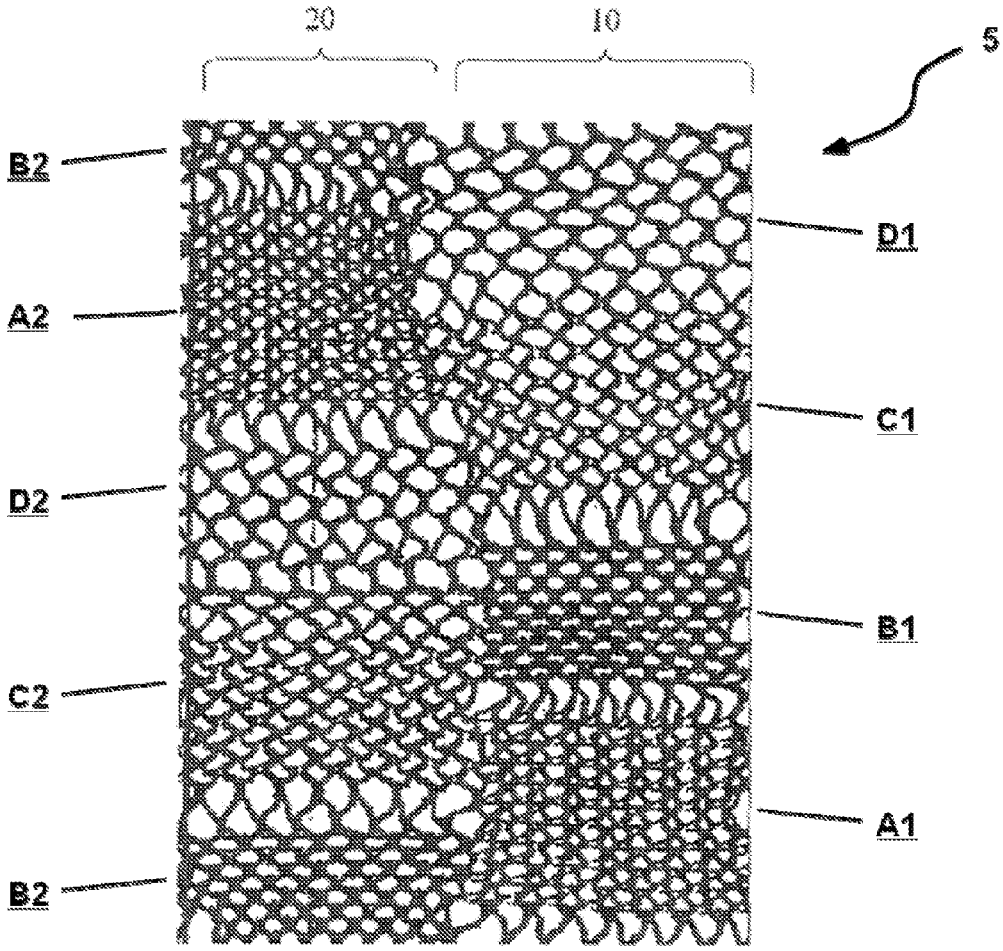
FIG. 6 is an enlarged view showing a portion that becomes one cycle in the ground organization shown in FIG. 5.

FIG. 5 is a view showing a ground organization having various design patterns according to a first embodiment of the present invention. FIG. 6 is an enlarged view showing a portion 5 that becomes one cycle in the ground organization 1 shown in FIG. 5.

Referring to FIGS. 5 and 6, the ground organization 1 has two-column unit designs 10 and 20 repeated in the transverse direction, and each of the unit designs 10 and 20 has a plurality of rectangular unit organizations consecutively arranged in the longitudinal direction. Here, it can be seen that the unit organizations are knitted in network structures having different shapes from one another.

The unit organizations are formed in a network structure by consecutively knitting warps fed to the first ground guidebar and warps fed to the second ground guidebar and/or the third ground guidebar in a loop shape. The loop shape of the network structure is changed depending on a chain number group of the chain linked with the guidebar.

The loop shape of the network structure forming the unit organization may be formed in any one of a quadrangular shape, a diamond shape, a lozenge shape and a hexagonal shape.

Figure 7:
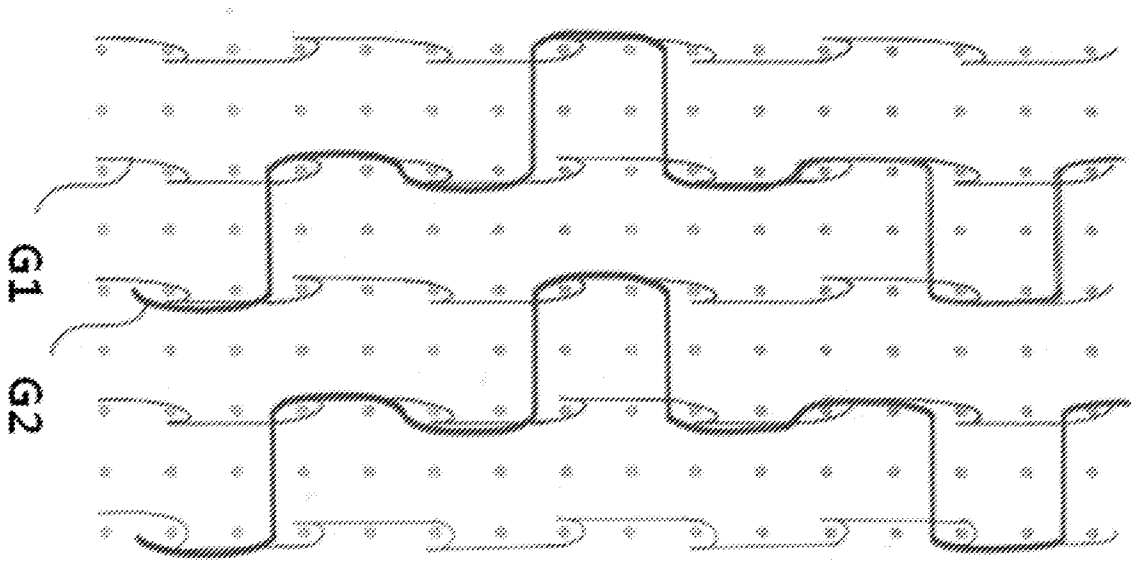
FIGS. 7 and 8 are design drafts for forming certain network structures.

FIG. 7 is a design draft for forming a rectangular network structure. The rectangular network structure is formed by linking the first ground guidebar with a chain of a chain number group of 2-0, 0-2, 2-0, 0-2, 2-0 and 0-2 and linking the second ground guidebar with a chain of a chain number group of 0-0, 2-2, 0-0, 4-4, 2-2 and 4-4.

Figure 8:
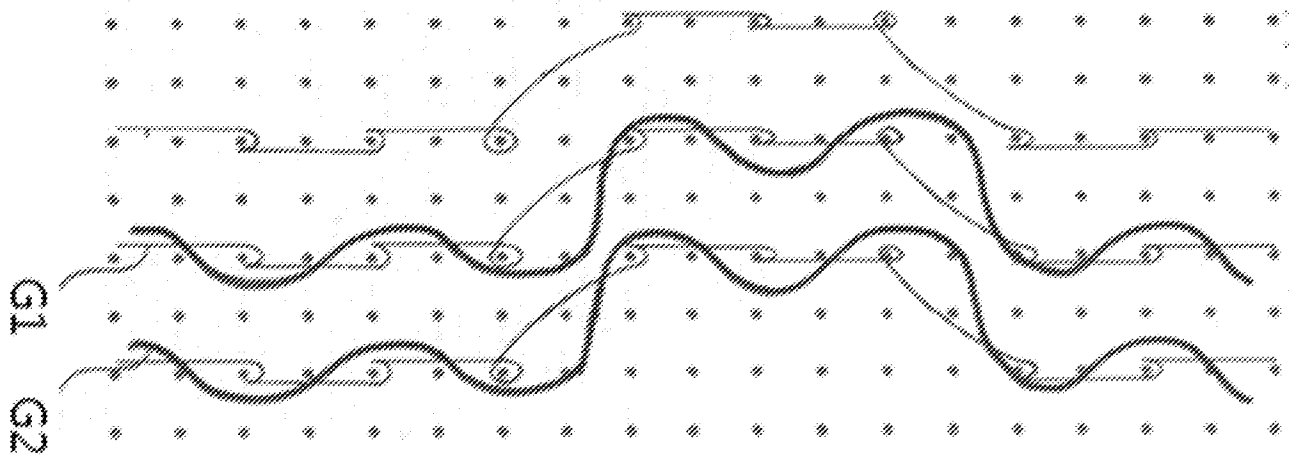

FIG. 8 is a design draft for forming a hexagonal network structure. The hexagonal network structure is formed by linking the first ground guidebar with a chain of a chain number group of 2-0, 0-2, 2-0, 2-4, 4-2 and 2-4 and linking the second ground guidebar with a chain of a chain number group of 0-0, 2-2, 0-0, 4-4, 2-2 and 4-4.

FIGS. 9 and 10 are chain layouts for forming a unit design according to a second embodiment of the present invention. However, the chain arrays are not limited thereto, and may be variously modified.

The chain connected along the chain layout knits one unit design, and a plurality of the unit designs are repeatedly knitted by circulating the chain.

The chain determining the operation of the first ground guidebar is wound around the ground chain guide drum. The chain is generally formed by assembling 16 to 24 unit chains.

However, since the number of assembled unit chains is small in the chain mounted to the ground chain guide drum, the shape of a design to be knitted is simple. Therefore, in the present invention, only the chain of the ground guidebar is mounted to the ground chain guide drum, and the chain operating the second and third ground guidebars is mounted to a separate chain guide drum. Accordingly, the chains operating the second and third ground guidebars can be extended long, and thus network structures having various shapes can be consecutively knitted.

In the second embodiment, each of the chains operating the second and third ground guidebars is formed by assembling one hundred seventy four unit chains. The number and shape of the assembled unit chains may be changed depending on the design of fabrics to be knitted.

In the second embodiment, the first ground guidebar is operated by a chain obtained by repeating a chain number group of 2-0, 0-2, 2-0 and 0-2, and the second ground guidebar is operated by the chain of the chain number group shown in the chain layout of FIG. 6. Referring to first to third rows of the chain layout, the number group of 2, 6, 4, 8, 4 and 6 is repeated. In this case, the numbers forms one chain number group, and a portion of a chain corresponding to the one chain number group knits a network structure having one shape. The chain number group of 2, 6, 4, 8, 4 and 6 is repeated seven times, which means that the chain number group is knitted by repeating a loop having the same shape seven times. The plurality of chain number groups repeated as described above knits one unit organization. That is, the portion of the chain, in which the number group of 2, 6, 4, 8 and 4 is repeated, knits a unit organization A1 of a first network structure.

Three chain numbers of 6, 4 and 6 followed by the chain number group knit a connection portion. Subsequently, another chain number group of 4, 8, 2, 6, 2 and 8 is repeated. The chain number group knits a network structure having a different loop shape from that of the previous chain number group.

That is, the portion of the chain, in which the chain number group of 4, 8, 2, 6, 2 and 8 is repeated, knits a unit organization B1 of a second network structure. The portion of the chain, in which the chain number group of 4, 8, 2 and 6 is repeated, knits a unit organization C1 of a third network structure. The portion of the chain, in which the chain number group of 4, 8, 4, 8, 4, 6, 2, 6, 2 and 6 is repeated, knits a unit organization D1 of a fourth network structure.

The combination of the one hundred seventy four unit chains shown in the chain layout knits one unit design. As the combination of the one hundred seventy four unit chains is circulated, the unit design is repeatedly knitted.

Similarly, the third ground guidebar is operated by a chain of chain numbers shown in the chain layout. In the second embodiment, the chain arrangement of the third ground guidebar is basically identical to that of the second ground guidebar, but is shifted by a certain unit chain. This means that the another unit design having the same network structure as the unit design formed by the second ground guidebar in the ground organization is arranged in parallel with the unit design formed by the second ground guidebar with different starting positions from each other.

Figure 11:
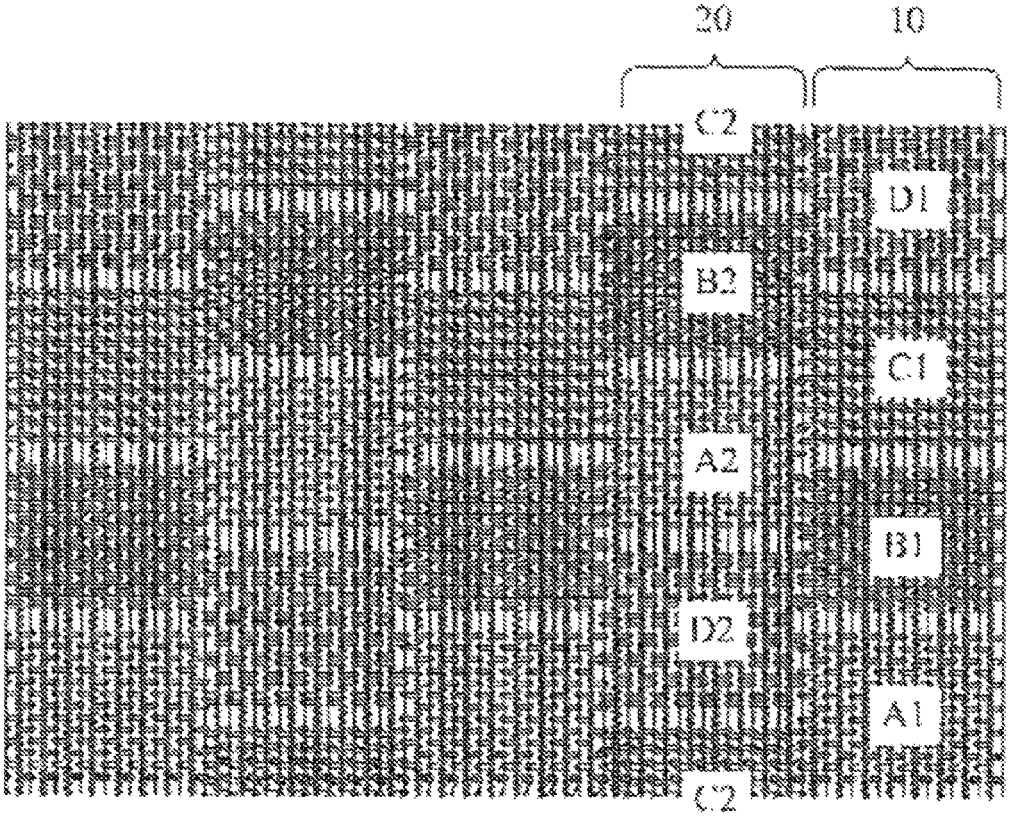
FIG. 11 is a design draft according to the chain layouts of FIGS. 9 and 10.

FIG. 11 is a design draft according to the chain layouts of FIGS. 9 and 10. The first unit design 10 is knitted by the first and second ground guidebars, and the second unit design 20 is knitted by the first and third ground guidebars.

The first unit design is knitted under the operation of the first and second ground guidebars, and has four different unit organizations A1, B1, C1 and D1 sequentially combined.

The second unit design is knitted under the operation of the first and third ground guidebars, and has four different unit organizations A2, B2, C2 and D2 sequentially combined.

Although it has been illustrated in this embodiment that the second unit design has the unit organizations arrayed so that the unit organizations having the same network structure as those of the first unit design, the second unit design may be formed by consecutively combining separate unit organizations having a network structure different from the unit organizations A1, B1, C1 and D1 of the first unit design.

FIGS. 12 to 20 are views showing array forms of the unit organizations in a ground organization.

Figure 12:
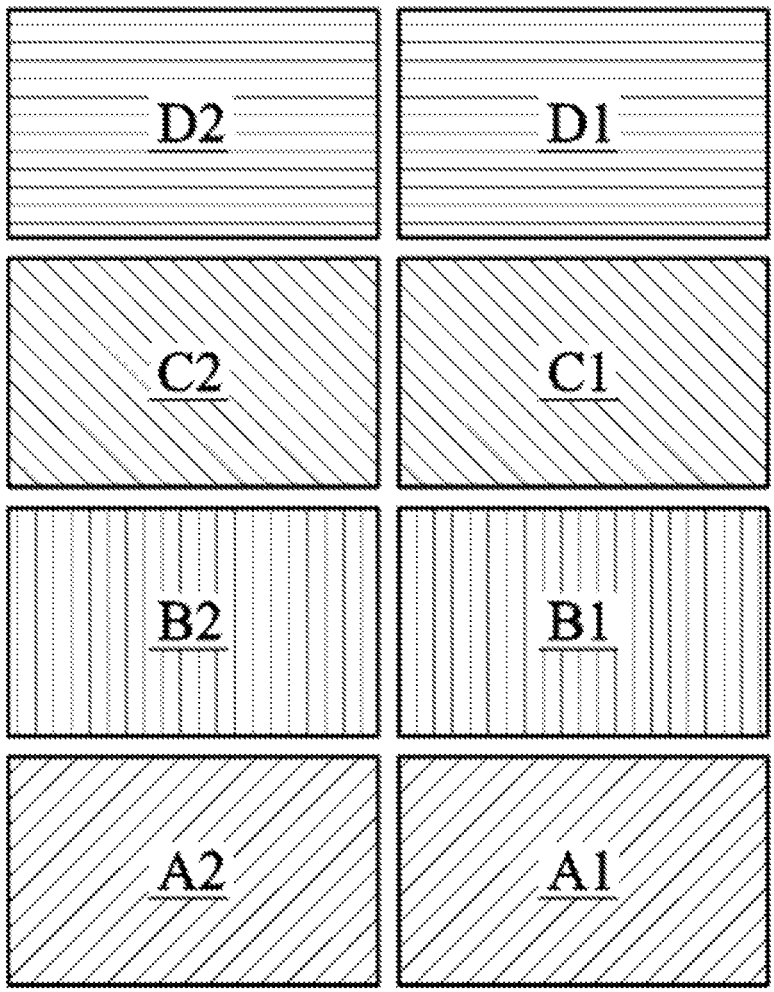
FIGS. 12 to 20 are views showing array forms of the unit organizations in a ground organization.
Figure 13:
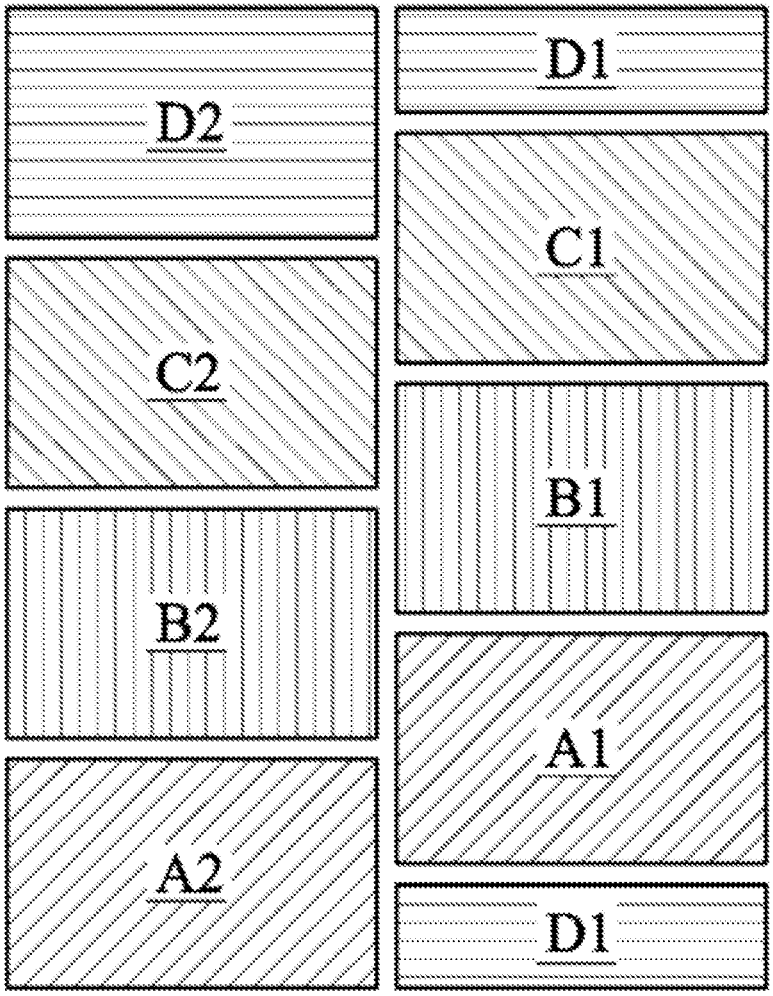
Figure 14:
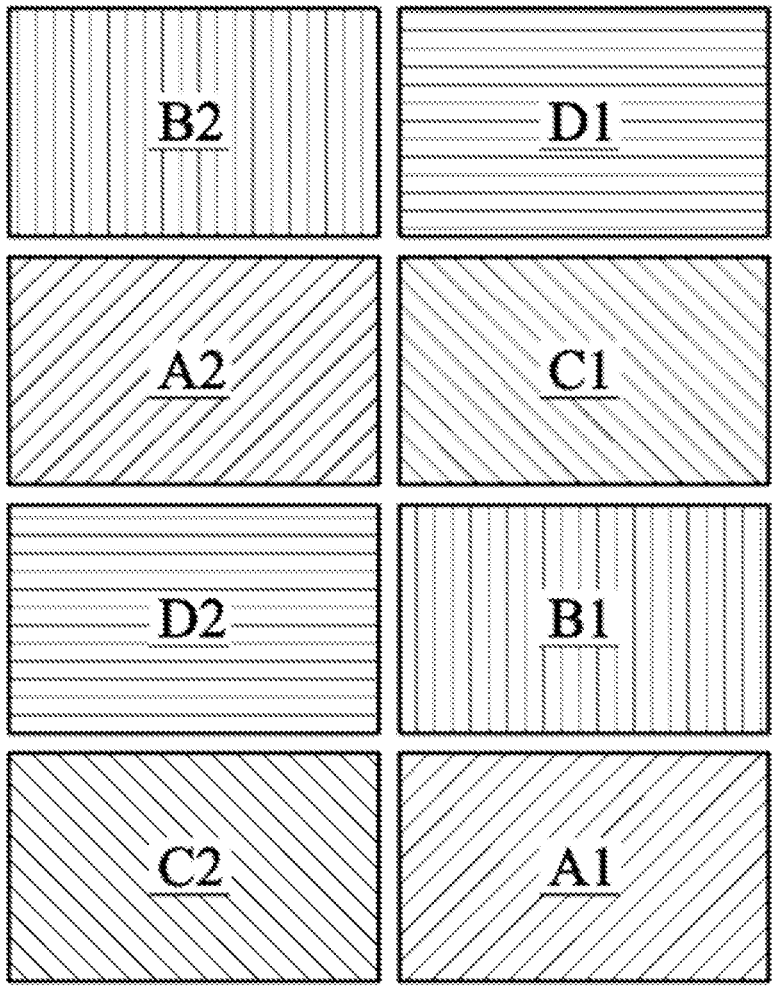
Figure 15:
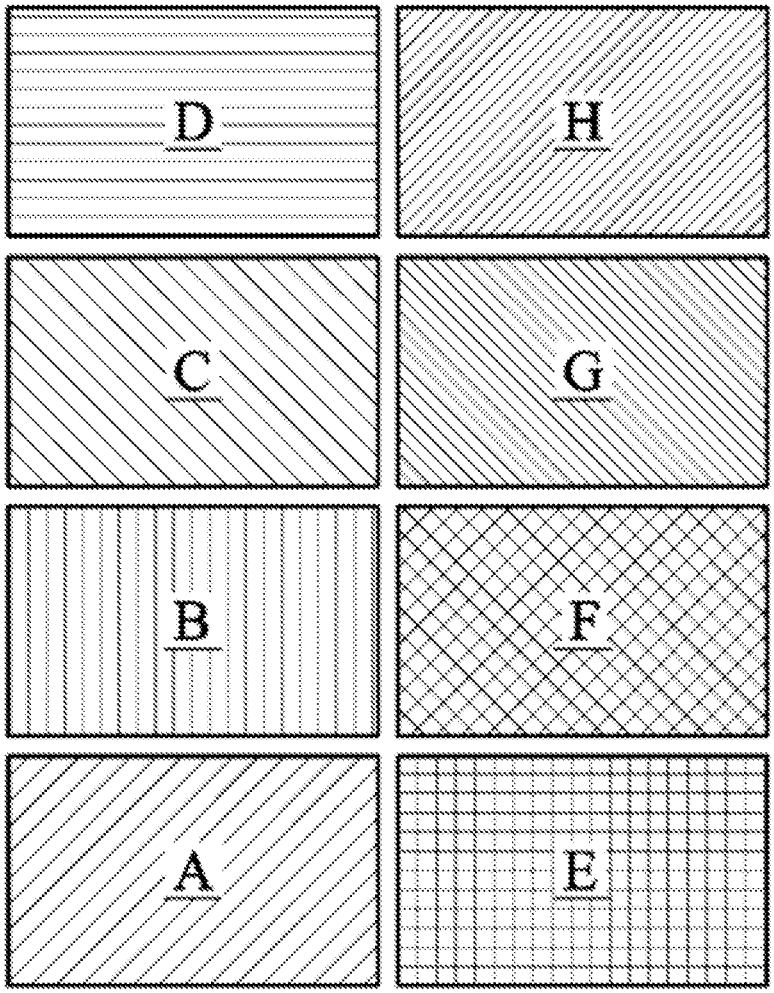

Referring to FIG. 12, the unit designs are arrayed in two rows in the ground organization, and are arrayed in parallel in the transverse direction of the unit organization. Referring to FIG. 13, the unit organizations are arrayed in zigzag in the transverse direction in the ground organization. Referring to FIG. 14, the unit organizations are irregularly arrayed in the ground organization. Referring to FIG. 15, the unit designs are arrayed in two rows in the ground organization, and the first and second unit designs have the unit organizations of different network structures from each other.

Figure 16:
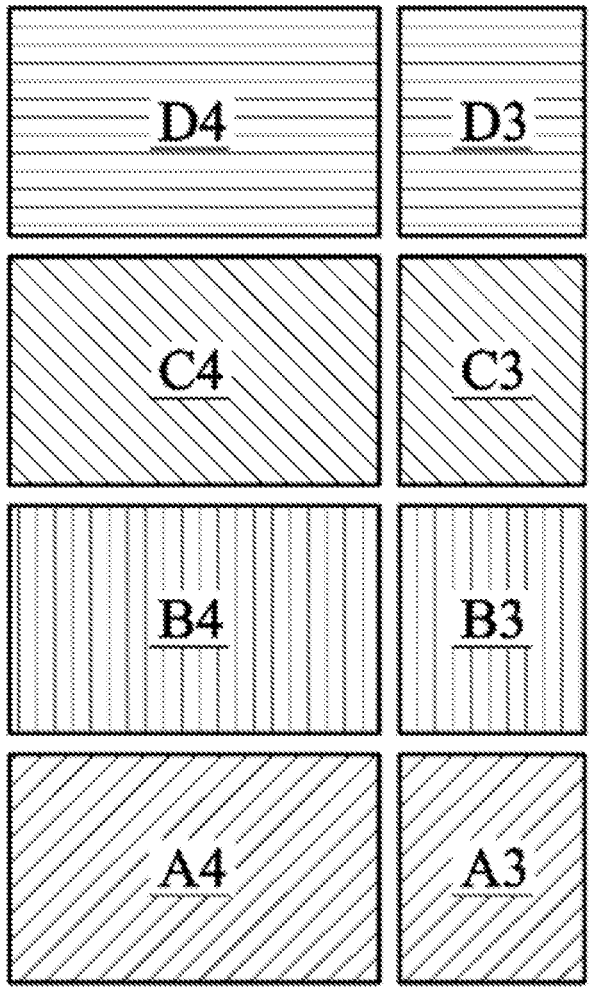

Referring to FIG. 16, the unit designs are arrayed in two rows, and the unit organizations are arrayed in parallel in the transverse direction. The width of the first unit design is formed different from that of the second unit design.

Figure 17:
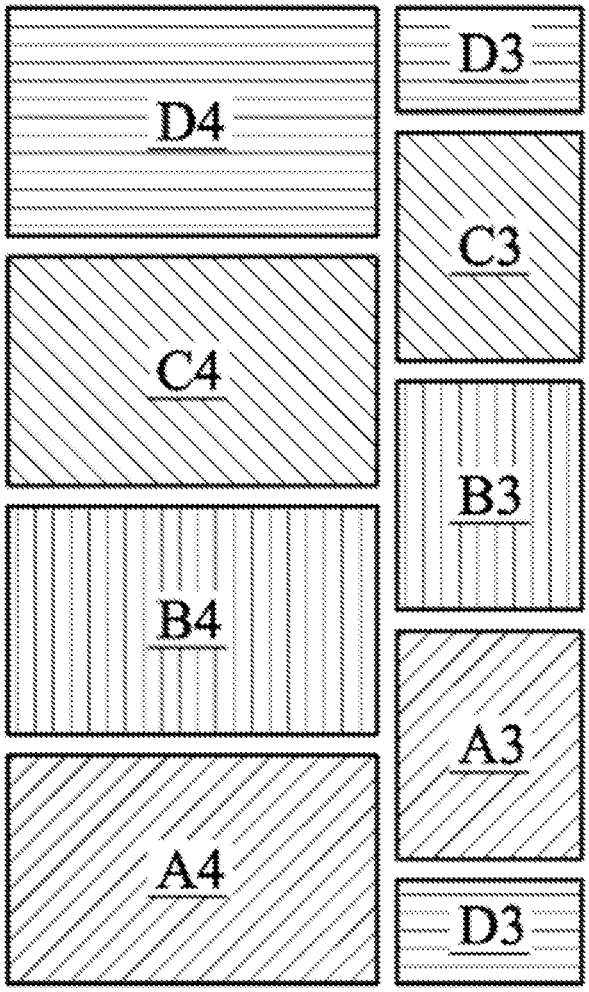

Referring to FIG. 17, the unit designs are arrayed in two rows, and the unit organizations are arrayed in zigzag in the transverse direction. The width of the first unit design is formed different from that of the second unit design.

Figure 18:
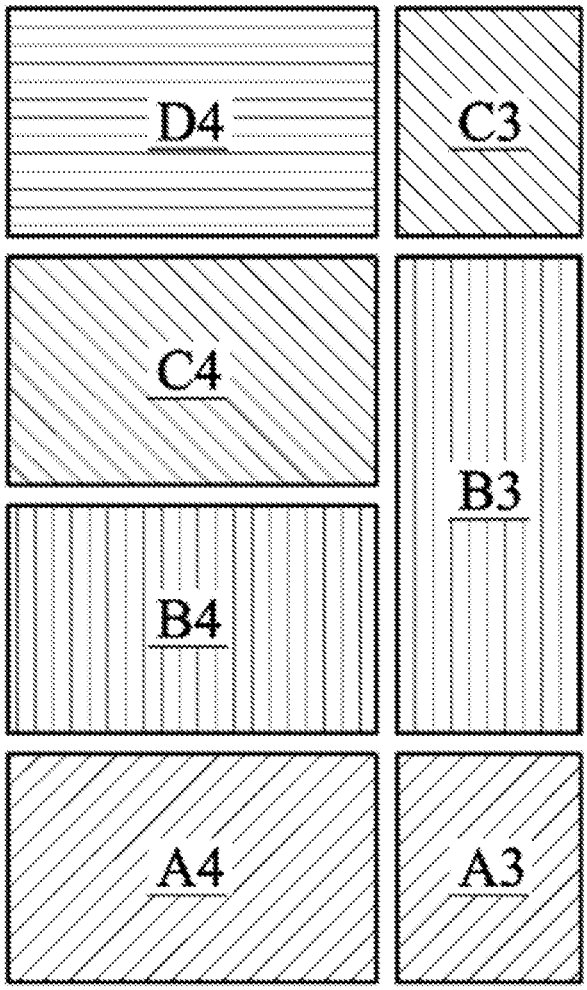

Referring to FIG. 18, the unit organizations are entirely arrayed in parallel in the transverse direction, and the heights of some unit arrays are formed differently.

Figure 19:
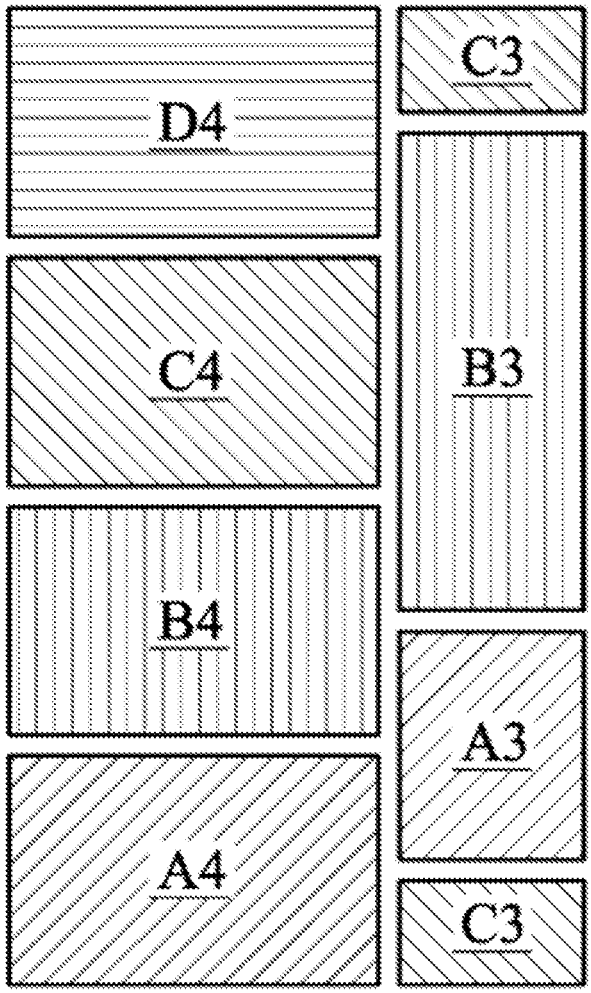

Referring to FIG. 19, the unit organizations are entirely arrayed in zigzag in the transverse direction, and the heights of some unit arrays are formed differently.

Figure 20:
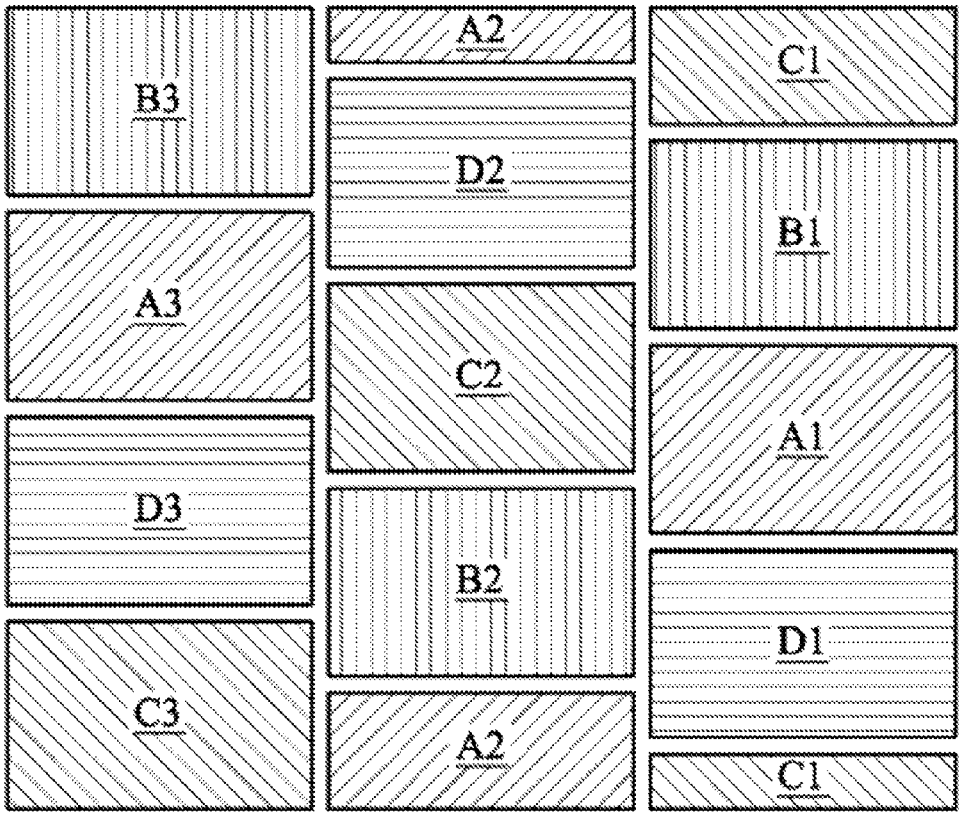

Although it has been illustrated in these embodiments described above that the unit designs are arrayed in two rows, the present invention is not limited thereto. That is, the unit designs may be arrayed in three or more rows by adding a ground guidebar. Referring to FIG. 20, the unit designs are arrayed in three rows, and the unit organizations are arrayed in zigzag in the transverse direction.

The ground organization configured with the plurality of unit organizations as described above may have array structures having various loop shapes by combining the unit organizations in a horizontal, zigzag, regular or irregular form. Thus, the present invention can provide a ground organization having various design patterns by circulating the unit organizations having various patterns.

Figure 21:
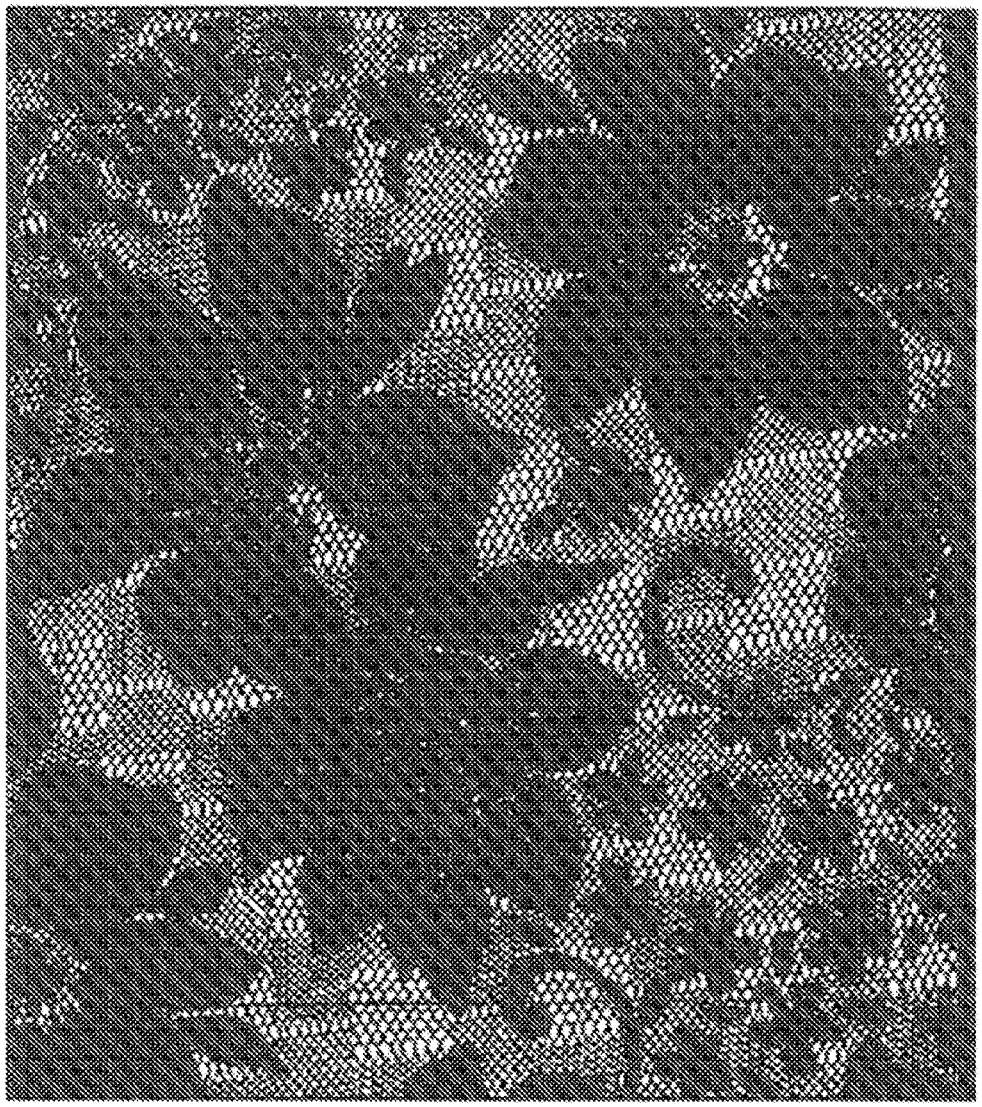
FIG. 21 is a view showing embodiments of warp knitting fabrics formed by adding a pattern shape on a ground organization according to the present invention.

FIG. 21 is a view showing embodiments of warp knitting fabrics formed by adding a pattern shape on a ground organization according to the present invention.

As shown in FIG. 21, the warp knitting fabrics forms one design by combining the ground organization and the pattern organization with each other. The loop shapes of network structures of generally used the ground organizations are rectangular, diamond, hexagonal or lozenge shapes, and loops having shapes changed based on the loop shapes may be used. The pattern organization is formed to have more complicated and various designs than the ground organization, based on the chain array of pattern chains.

That is, a design is formed by combining the ground organization and the pattern organization with each other, and the ground organization can complement designs of the pattern organization to become more various and high-quality designs. Thus, the present invention can provide warp knitting fabrics having a high-quality design by systematically connecting the ground organization and the pattern organization to each other.

Although the present invention has been described in connection with the accompanying drawings and the preferred embodiments, the present invention is not limited thereto but defined by the appended claims. Accordingly, it will be understood by those skilled in the art that various modifications and changes can be made thereto without departing from the spirit and scope of the invention defined by the appended claims.

The invention claimed is:

1. Warp knitting fabrics, comprising:

a ground organization formed with warps knitted into a loop shape; and a pattern organization knitted on the ground organization, wherein the ground organization includes two or more unit designs continuously arranged in a transverse direction of the ground organization, each of the unit designs comprises two or more unit organizations arranged in a longitudinal direction of the ground organization, each of the unit organizations comprising a specific loop shape of a network structure formed by a chain of a specific chain number group comprising an array of a plurality of chain numbers, and each of the unit organizations has a different loop shape of a network structure from each other.

2. The warp knitting fabrics according to claim 1, wherein each of the unit organizations is formed by consecutively knitting a plurality of loops having the same shape in the longitudinal direction.

3. The warp knitting fabrics according to claim 1, wherein the unit organizations are knitted by at least two ground guidebars linked with the chain of the specific chain number group comprising the array of the plurality of chain numbers.

4. The warp knitting fabrics according to claim 1, wherein the loop shape of the network structure is any one of a quadrangular shape, a diamond shape, a lozenge shape and a hexagonal shape.

5. The warp knitting fabrics according to claim 1, wherein the ground organization comprises at least two-row unit designs, and the unit organizations of any one unit design are arrayed in zigzag with the unit organizations of another unit design in the transverse direction.

6. The warp knitting fabrics according to claim 1, wherein the ground organization comprises at least two-row unit designs, and the unit organizations of any one unit design are arrayed in parallel with unit the organizations of another unit design in the transverse direction.

7. The warp knitting fabrics according to claim 1, wherein the ground organization comprises at least two-row unit designs, and the width of any one unit design is wider than that of another unit design adjacent to the one unit design in the transverse direction.

8. The warp knitting fabrics according to claim 1, wherein the length of one unit organization is longer than that of another unit organization adjacent to the one unit organization in the longitudinal direction.

* * * * *